US006145258A

United States Patent [19]

Barnoff

[11] Patent Number: 6,145,258

[45] Date of Patent: Nov. 14, 2000

[54] REMOVABLE SELF-LOCKING CHIMNEY CAP

[75] Inventor: Dalton B. Barnoff, Senneville, Canada

[73] Assignee: Trans Continental Equipment Ltd., Montreal, Canada

[21] Appl. No.: 09/345,494

[22] Filed: Jul. 1, 1999

[51] Int. Cl.[7] ..... E04H 12/28

[52] U.S. Cl. ..... 52/244; 52/300

[58] Field of Search ..... 52/244, 300, 218, 52/219

[56] References Cited

U.S. PATENT DOCUMENTS

| | | | |
|---|---|---|---|
| 650,026 | 5/1900 | Schoppe | 52/244 |
| 2,830,525 | 4/1958 | Wilhite | 52/244 |
| 2,956,495 | 10/1960 | Sublette | 52/244 |
| 3,089,521 | 5/1963 | Paiement | 52/244 |

*Primary Examiner*—David M. Purol
*Attorney, Agent, or Firm*—Swabey Ogilvy Renault

[57] ABSTRACT

The present invention relates to a removable, self-locking chimney cap which is screwless. The chimney cap comprises a stationary member and a removable member removably mountable to the stationary member. The stationary member comprises a base plate adapted to be secured to the end of the chimney or venting system and defining an opening, and a first tube mounted to the base plate around the opening. The removable member comprises a second tube adapted to slide over the first tube and a cap mounted to the second tube, the first and the second tubes comprising a pin and a corresponding bayonet slot adapted to receive the pin, whereby when the second tube slides over the first tube, the pin is received by the bayonet slot and locks the removable member with the stationary member. Such a chimney cap may be manually locked and unlocked in a single step, without the use of tools.

2 Claims, 3 Drawing Sheets

REMOVABLE SELF-LOCKING CHIMNEY CAP

BACKGROUND OF THE INVENTION (a) Field of the Invention

The present invention relates to removable chimney caps and more particularly to a self-locking chimney cap which is screwless.

(b) Description of Prior Art

Materials generally used to build chimneys, such as brick and mortar, are porous and thus susceptible to weather conditions. Chimney caps, or rain covers, are therefore generally installed on chimneys to prevent rain and snow from deteriorating the chimney, and to prevent leaves, branches, birds and other animals from entering the chimney and causing a blockage thereof and a fire hazard. Chimney caps also arrest sparks from igniting combustible material neighboring the chimney and may eliminate wind-induced downdrafts. Chimney caps are generally made from a variety of materials such as galvanized sheet-metal, stainless steel and copper. Liners such as of the flexible coiled type are often installed into the flue cavity of the chimney for heat insulation.

Chimney caps need to be periodically removed to allow the chimneys and venting systems to be inspected and maintained, to avoid fire hazards and the like.

Removable chimney caps are known. Chimney caps of the removable type usually comprise a base plate screwed to the chimney around the opening thereof and a tube mounted to the base plate. A removable rain cap is then mounted to the tube and secured thereto using clamps, screws or the like.

A problem with such a securement is that the rain cap can not be readily removed from the base plate without the use of appropriate tools, which renders the removal of the chimney cap a multiple-step maneuver, which is hazardous and time consuming.

It would therefore be highly desirable to provide a chimney cap which would be manually locked and unlocked in a single step, without the use of tools.

SUMMARY OF THE INVENTION

One aim of the present invention is to provide a chimney cap which may be manually locked and unlocked in a single step, without the use of tools.

In accordance with the present invention, there is provided a removable, self-locking chimney cap device for covering an end of a chimney or a venting system. The chimney cap device comprises a stationary member and a removable member removably mountable to the stationary member. The stationary member comprises a base plate portion adapted to be secured to the end of the chimney or venting system and defining an opening, and a first tubular portion mounted to the base plate portion around the opening. The removable member comprises a second tubular portion adapted to slide over the first tubular portion and a cap portion mounted to the second tubular portion. The first and the second tubular portions comprise a pin member and a corresponding bayonet slot adapted to receive the pin member, whereby when the second tubular portion slides over the first tubular portion, the pin member is received by the bayonet slot and locks the removable member with the stationary member.

BRIEF DESCRIPTION OF THE DRAWINGS

Having thus generally described the nature of the invention, reference will now be made to the accompanying drawings, showing by way of illustration a preferred embodiment thereof, in which like numerals refer to like components, and in which.

DETAILED DESCRIPTION OF THE INVENTION

Figure 1:
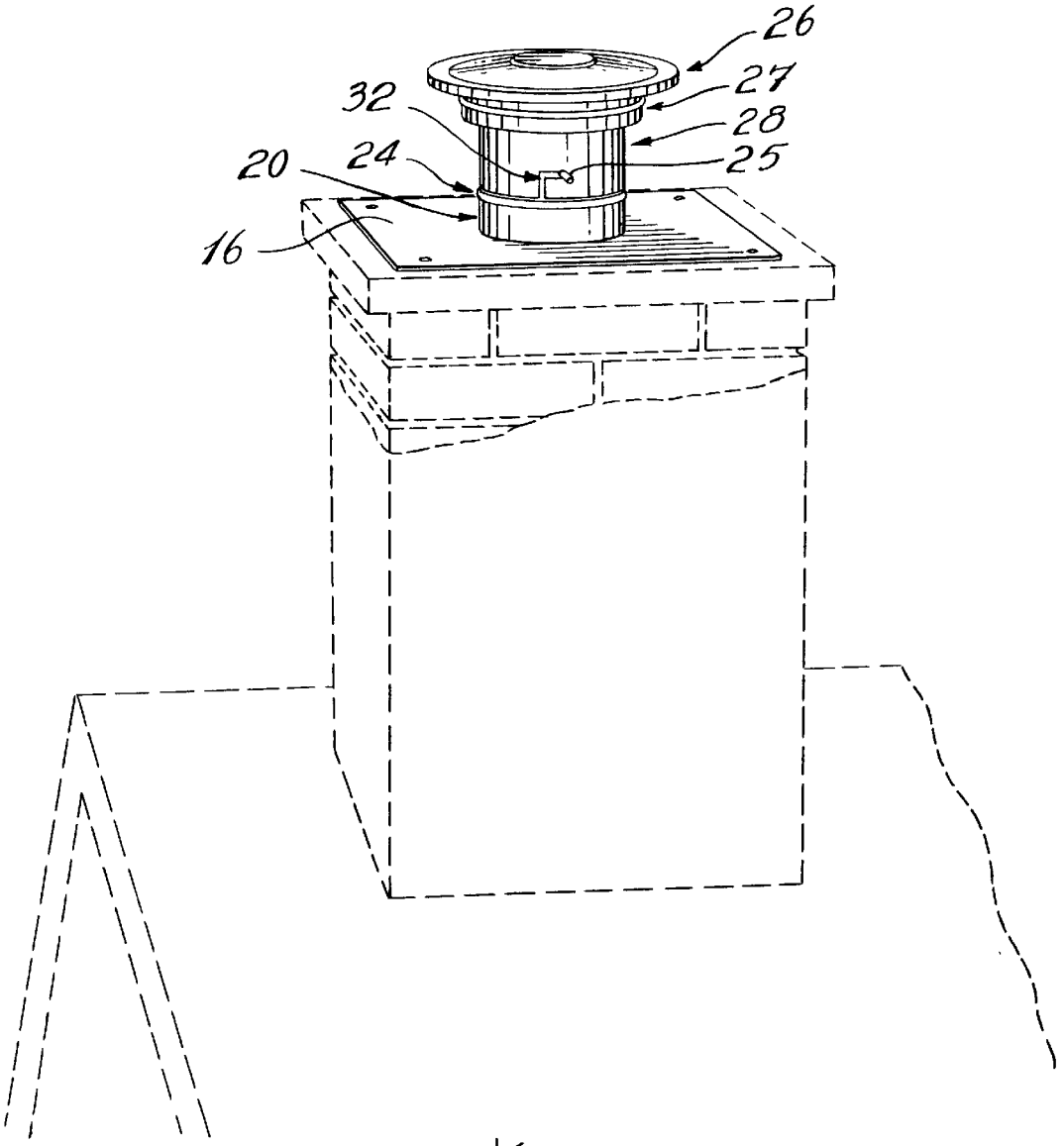
FIG. 1 is a perspective view showing an embodiment of a removable, self-locking chimney cap device in accordance with the present invention mounted to the mortar crown of a chimney.

As may be seen in FIG. 1, the chimney cap device of the present invention, identified with reference numeral 10, comprises a stationary member 12 and a removable member 14, which is removably mountable to the stationary member 12 as will be explained hereinafter.

Figure 2:
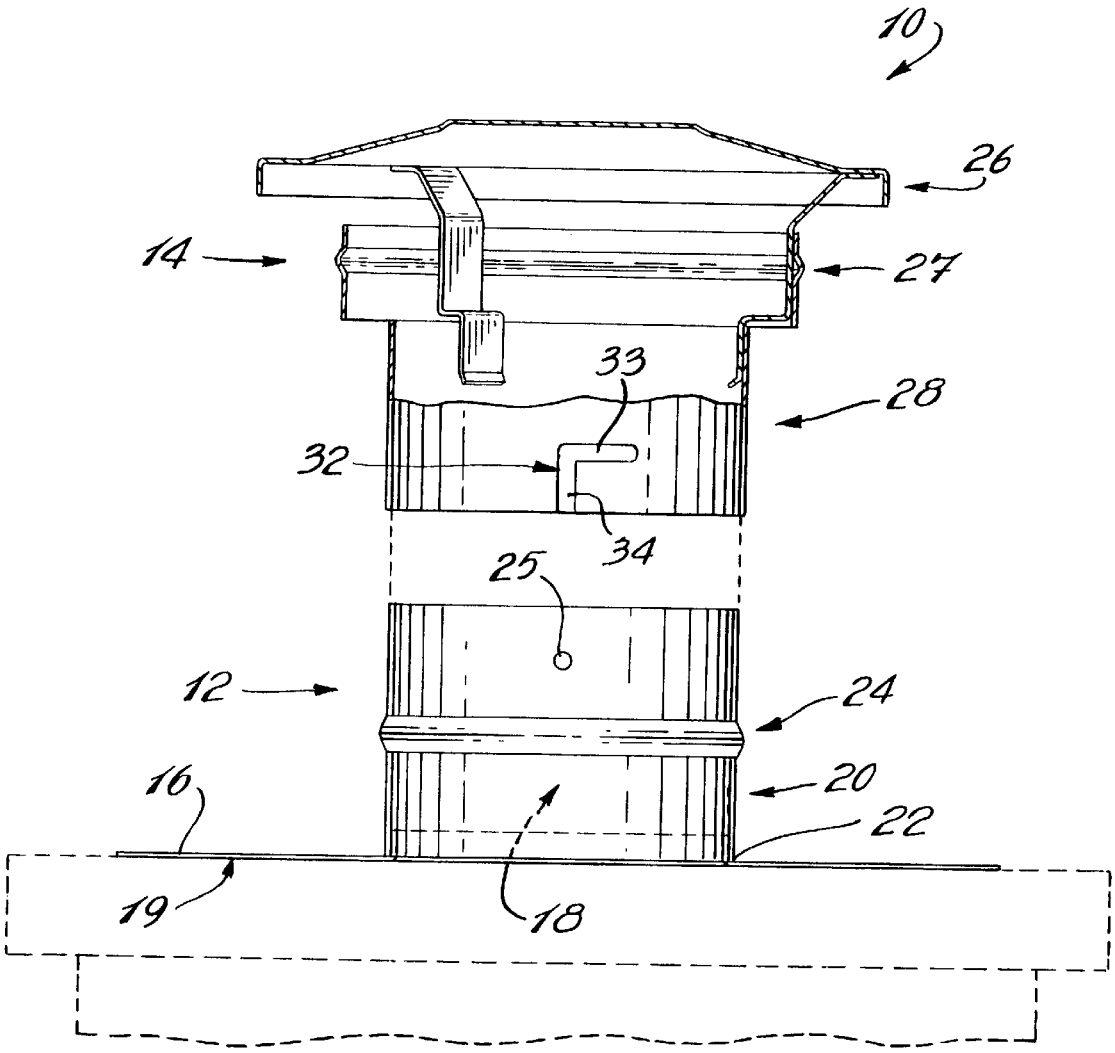
FIG. 2 is an exploded side view of the embodiment shown in FIG. 1, showing the stationary member and the removable member thereof.
Figure 3:
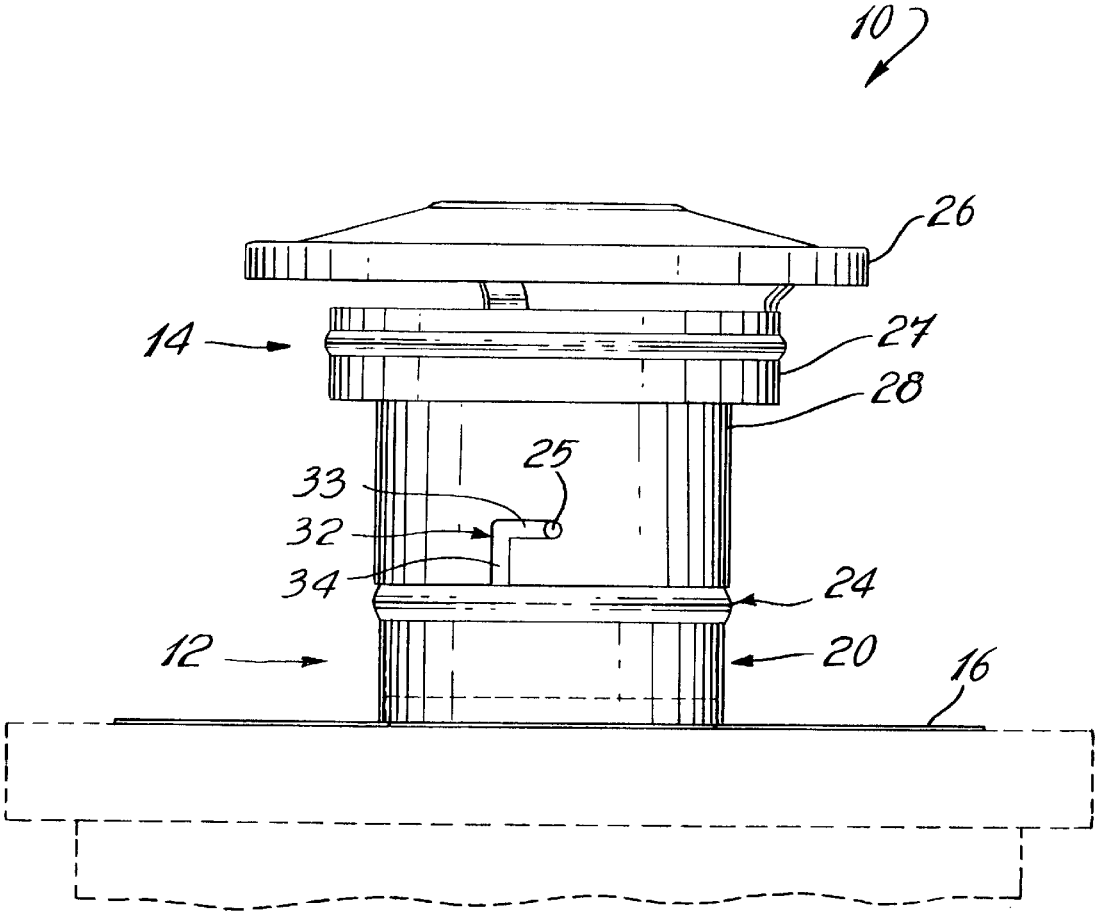
FIG. 3 is a side view of the embodiment shown in FIG. 1, showing the removable member mounted to the stationary member.

As may be seen in FIGS. 2 and 3, the stationary member 12 comprises a base plate 16 of a generally planar and rectangular configuration. The base plate 16 defines an opening 18 at the center thereof, which is of a generally circular configuration.

As seen in FIG. 1, the base plate 16 is also provided with small openings 19 at each corner thereof to allow insertion of screws therein.

Returning to FIGS. 2 and 3, a sleeve 20 of a generally tubular configuration has a lower end 22 thereof secured to the base plate 16 around the opening 18 thereof. The lower end 22 of the sleeve 20 may be secured to the base plate 16 by any suitable means, such as welding. The sleeve 20 has a diameter which substantially corresponds to that of the opening 18 of the base plate 16. The sleeve 20 may be formed by rolling a sheet-metal in a tubular configuration to the appropriate diameter and by welding together the meeting edges. The sleeve 20 may then be welded to the base plate 16 as mentioned above.

A bead 24 is provided on the outer surface of the sleeve 20, at substantially mid-height thereof. A pin 25 is provided on the sleeve 20 slightly above the bead 24. The pin 25 projects outwardly from the sleeve 20 relative to a chimney axis.

The removable member 14 consists of a chimney cap 26, which is mounted to a first tube 27, which is mounted to a second tube 28 having a diameter slightly superior to that of the sleeve 20 of the stationary member 12. A bayonet slot 32 is provided to the second tube 28. The bayonet slot 32, which is L-shaped, has a first engaging section 33 and a second locking section 34. The bayonet slot 32 is adapted to engage the pin 25 projecting from the sleeve 20 of the stationary member 12.

The removable, self-locking chimney cap device 10 operates as follows. The base plate 16 is first screwed to the roof around the venting system or to the mortar crown of the chimney. The removable member 14 is then mounted to the stationary member 12 by sliding the second tube 28 thereof onto the sleeve 20 and by rotating the removable member 14 to align the pin 25 projecting from the sleeve 20 with the bayonet slot 32 of the second tube 28. Once aligned, the pin 25 is inserted in the engaging section 33 of the bayonet slot 32 by pressing the removable member 14 downardly. The removable member 14 is then rotated to lock the pin 25 into the locking section 34 of the bayonet slot 32. The bead 24 of the sleeve 20 projects outwardly relative to the chimney axis sufficiently to support and prevent the second tube 28, once slidably mounted to the sleeve 20, from sliding further down thereon.

While the invention has been described with particular reference to the illustrated embodiment, it will be understood that numerous modifications thereto will appear to those skilled in the art. Accordingly, the above description and accompanying drawings should be taken as illustrative of the invention and not in a limiting sense.

What is claimed is:

1. A removable, self-locking chimney cap device for covering an end of a chimney or a venting system, said chimney cap device comprising a stationary member and a removable member removably mountable to said stationary member, said stationary member comprising a base plate portion adapted to be secured to said chimney or venting system end and defining an opening, a first tubular portion mounted to said base plate portion around said opening, said removable member comprising a second tubular portion adapted to slide over said first tubular portion and a cap portion mounted to said second tubular portion, said first and second tubular portions comprising a pin member and a corresponding bayonet slot adapted to receive said pin member, whereby when said second tubular portion slides over said first tubular portion, said pin member is received by said bayonet slot and locks said removable member with said stationary member.

2. A removable, self-locking chimney cap device according to claim 1, wherein said pin member is disposed on said first tubular portion and said bayonet slot is disposed on said second tubular portion.

* * * * *